US009863162B2

(12) United States Patent
Whiteley

(10) Patent No.: US 9,863,162 B2
(45) Date of Patent: Jan. 9, 2018

(54) BASE FOR FENCING

(71) Applicant: Oxford Plastic Systems Limited, Enstone, Oxfordshire (GB)

(72) Inventor: Christopher Whiteley, Finmere (GB)

(73) Assignee: OXFORD PLASTIC SYSTEMS LIMITED, Enstone, Oxfordshire (GB)

( * ) Notice: Subject to any disclaimer, the term of this patent is extended or adjusted under 35 U.S.C. 154(b) by 430 days.

(21) Appl. No.: 14/348,466

(22) PCT Filed: Sep. 28, 2012

(86) PCT No.: PCT/GB2012/052414
§ 371 (c)(1),
(2) Date: Mar. 28, 2014

(87) PCT Pub. No.: WO2013/045946
PCT Pub. Date: Apr. 4, 2013

(65) Prior Publication Data

US 2014/0231737 A1 Aug. 21, 2014

(30) Foreign Application Priority Data

Sep. 29, 2011 (GB) ..... 1116782.2

(51) Int. Cl.

| | |
|---|---|
| ***E04H 17/22*** | (2006.01) |
| ***E04H 12/22*** | (2006.01) |
| ***E04H 17/16*** | (2006.01) |
| ***E01F 9/692*** | (2016.01) |

(52) U.S. Cl.
CPC ..... *E04H 12/2253* (2013.01); *E01F 9/692* (2016.02); *E04H 12/2238* (2013.01); *E04H 17/16* (2013.01)

(58) Field of Classification Search
CPC ... E01F 9/692; E01F 9/60; E01F 9/673; E01F 9/623; E01F 9/688; E01F 13/02; E01F 13/022; E04H 17/22; E04H 17/00
See application file for complete search history.

(56) References Cited

U.S. PATENT DOCUMENTS 4,900,090 A * 2/1990 Davis ..... A47C 5/12 297/440.1
5,484,225 A * 1/1996 Warner ..... E01F 9/692 116/63 C (Continued)

FOREIGN PATENT DOCUMENTS

AU 2009202587 * 1/2010 ..... E04H 17/22
DE 196 52 696 * 6/1998 ..... E04H 17/22

(Continued)

*Primary Examiner* — Michael P Ferguson
(74) *Attorney, Agent, or Firm* — O'Shea Getz P.C.

(57) ABSTRACT

A base for supporting posts of fencing, which base includes a block of plastics provided with apertures for receiving the ends of fencing posts. Each end of the block is provided with a gripping portion which projects longitudinally away from the main body of the block. A first interlocking means is associated with one of the gripping portions and interlocks with a corresponding second interlocking means of a cover which is fitted to the block over the gripping portion. The cover is of enhanced visibility compared to the main body of the block which is of a dull color.

13 Claims, 6 Drawing Sheets

(56) References Cited

U.S. PATENT DOCUMENTS

| | | | | |
|---|---|---|---|---|
| 7,631,409 | B2 * | 12/2009 | Dehlsen | E04H 12/2238 256/24 |
| 8,453,995 | B2 * | 6/2013 | Christensen | B29C 49/482 256/13.1 |
| 2008/0237560 | A1 | 10/2008 | Dehlsen | |

FOREIGN PATENT DOCUMENTS

| | | | | |
|---|---|---|---|---|
| DE | 19652696 | | 6/1998 | |
| EP | 1 477 497 | * | 8/2004 | E04H 12/22 |
| EP | 1447497 | | 8/2004 | |
| GB | 2 349 655 | * | 8/2000 | E04H 12/22 |
| GB | 2349655 | | 11/2000 | |
| NL | 9401555 | * | 9/1994 | E04H 17/22 |

* cited by examiner

Figure 15
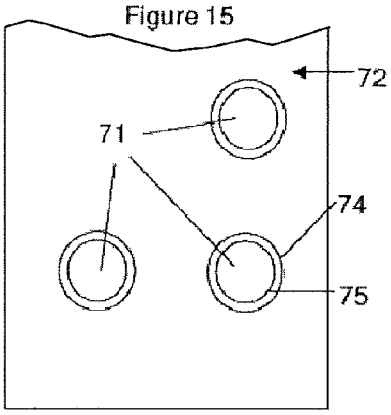
Figure 16
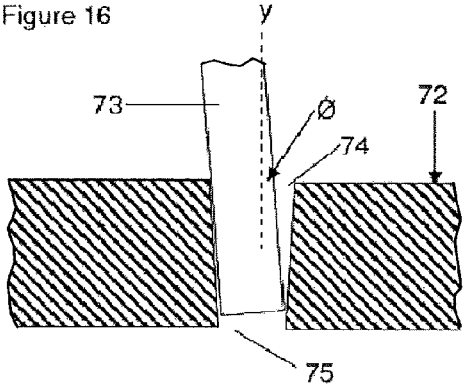
Figure 17
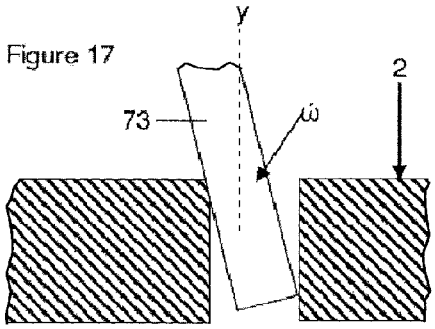
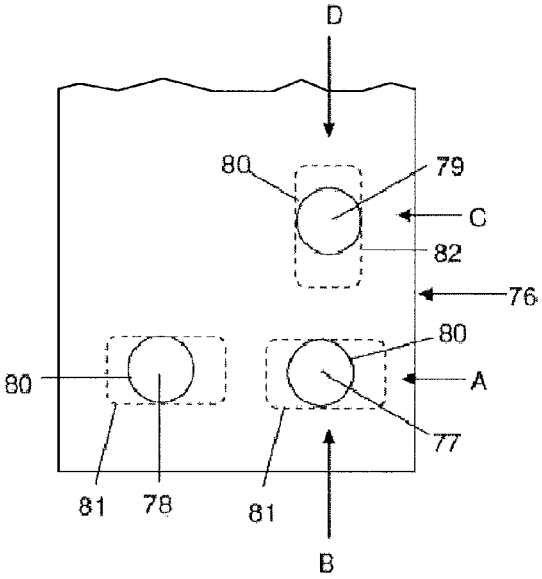
Figure 18
Figure 19
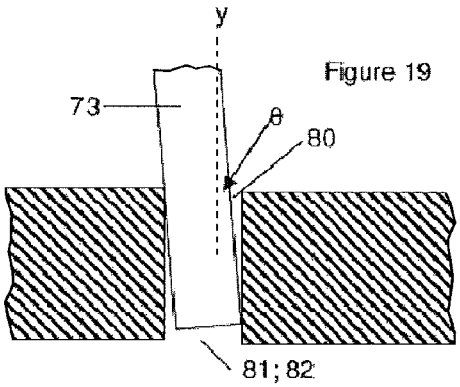
Figure 20
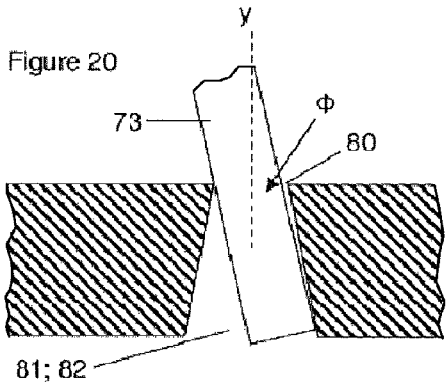

BASE FOR FENCING

This application is entitled to the benefit of, and incorporates by reference essential subject matter disclosed in PCT Application No. PCT/GB2012/052414 filed on September 28, which claims priority to Great Britain Application No. 1116782.2 filed Sep. 29, 2011.

BACKGROUND OF THE INVENTION

1. Technical Field

This invention relates to a base for fencing. The invention is particularly, but not exclusively, concerned with a base for temporary fencing of the type that comprises a number of prefabricated fence panels, each of which has a support post adjacent each end. Typically the base will have at least two apertures in an upper surface, one of which receives the post at one end of one panel, and other of which receives the post at one end of another panel.

2. Background Information

A base of this type is marketed under the trade mark OxBlock™ by Oxford Plastic Systems Limited of Enstone, Oxfordshire, UK. It is in the form of a block moulded from recycled thermoplastic material and is generally used with galvanized steel fence panels, although a base in accordance with the present invention could be used with other types of fence panels, such as plastic barriers. The OxBlock™ base has a handle projecting from the main body of the block at each end, which can be gripped so that the base can be easily carried and manipulated into place. The base is elongate, and in general the longer direction will extend approximately perpendicular to the planes of the fencing panels which are connected to the base, to resist the fencing panels tilting.

An object of the present invention is to provide a way of enhancing the visibility of a base for fencing, so as to reduce the chances of a person tripping over the support. United Kingdom Patent No. GB 2349655 discloses a base for supporting posts of fencing, comprising a block having a main body with a lower surface, an upper surface, two ends and two sides, wherein the lower surface is for resting on a support and the upper surface is provided with at least two apertures for receiving the respective ends of fencing posts to project upwardly from the upper surface; and each end of the block is provided with a gripping portion. In this arrangement, each end of the block is provided with a recess, and aligned apertures are arranged either side of the recess. A handle passes through the apertures and across the recess, and this handle can be brightly colored. A problem with this arrangement is that the handle is within the recess and inset from the ends of the block, so that it is of limited use in alerting a pedestrian to the presence of the ends of the block.

SUMMARY OF THE INVENTION

Viewed from a first aspect, the present invention provides a base for supporting posts of fencing, comprising a block having a main body with a lower surface, an upper surface, two ends and two sides, wherein the lower surface is for resting on a support and the upper surface is provided with at least two apertures for receiving the respective ends of fencing posts to project upwardly from the upper surface; and each end of the block is provided with a gripping portion which projects longitudinally away from the main body of the block; characterized in that a first interlocking portion is associated with one of the gripping portions and interlocks with a corresponding second interlocking portion of a cover which is fitted to the block over the gripping portion, the cover being of enhanced visibility compared to the main body of the block.

The cover may be provided with (i) a top, upwardly directed face; and/or (ii) at least one sideways directed face; and/or (iii) an end face. By using suitable colors and/or reflectors on an upwardly directed face and/or a sideways directed face and/or an end face of a cover, it is possible to bring a pedestrian's attention to the presence of the base if they are walking close to the fence. This will reduce the chance of a person tripping over the base, the main body of which may be of a dull color. Thus the cover may be of a contrasting color and for example may be of a high visibility color. Suitable colors could be, for example, bright and/or fluorescent yellow or orange. Additionally or alternatively, reflecting portions could be, for example, white or any other suitable color. The cover could also be used to display a company name, trade mark, warning message or anything else of interest to a pedestrian. Preferably, however, the appearance is sufficiently bright or eye catching to ensure that a pedestrian will appreciate that there is a base projecting from the fencing and will avoid being tripped up.

In one embodiment, a respective first interlocking portion is associated with each of the gripping portions and is adapted to interlock with a corresponding second interlocking portion of a respective cover, so that a cover can be fitted to the block over each of the gripping portions if desired. In a preferred embodiment, a respective cover is fitted to the block over each of the gripping portions.

Thus, in such an embodiment a cover can be provided at both ends of the block. However, whilst the block is adapted to have a cover at both ends, it could be supplied with a cover at one end only. This would be possible if people will be walking on only one side of a fence, in which case the cover would be on the end of the block projecting on that side of the fence. However, there is a risk of a worker positioning the block with the wrong end projecting and thus it is preferred to provide a cover at both ends.

In some embodiments the cover has an upwardly directed face and a pair of sideways directed faces. In some embodiments, in addition to those faces, the cover portion has an end face. In some embodiments all of the upwardly directed, sideways directed and end faces are of enhanced visibility compared to the main body of the block, for example being provided in an eye catching color. In some embodiments, the sideways directed faces are provided with reflectors.

The gripping portions are used by an operative to lift the base. In some embodiments, at each end of the block there is provided a projection which comprises an upright on one side of the block, an upright on the other side of the block, and an upper cross member extending between the two uprights. The cross member serves as the gripping portion, as the fingers of a user can be positioned underneath the cross member. In such an arrangement the cover may comprise a first cover part on one side of the block which covers at least part of the side of the upright on that side of the block; a second cover part which covers at least part of the top of the cross member; and a third cover part on the other side of the block which covers at least part of the side of the upright on that side of the block.

In some embodiments, the cover comprises a fourth cover part which covers at least part of the end facing part of the upright on said one side of the block; and a fifth cover part which covers at least part of the end facing part of the upright on said other side of the block. Preferably, the cover comprises a sixth cover part which covers at least part of the end facing part of the cross member.

The cover should not obstruct the use of the cross member as a gripping portion. In general form, the cover could resemble a bridge type structure having an upright on one side of the block, an upright on the other side of the block and an upper cross member extending between the two uprights. The shape and dimensions will be such that these uprights and cross member can be placed over the uprights and cross member of the projection at the end of the block.

In some embodiments, the projection at the end of the end of the block has uprights with enlarged lower ends. The uprights of the cover are shorter than the uprights of the projection, and thus terminate adjacent the enlarged lower ends.

In some embodiments of the invention, the cover is displaced inwardly from the extremities of the block, so as to protect the cover from damage. Thus uprights can be displaced inwardly from the side of the block, and also upwardly from the base of the block and inwardly from an extreme end of the block; a cross member can be displaced downwardly from the upper surface of the block and inwardly from an extreme end of the block; and an end face can be displaced inwardly from the extreme end of the block. In some embodiments the extreme end of the block is defined by the outer most part of the enlarged lower ends of uprights of the block.

To interlock the cover to the block, there may be grooves, apertures or the like provided on the block into which corresponding interlocking parts of the cover form a snap fit. For example, in the case of there being a projection at the end of the block, as described above, there may be one or more grooves, apertures or the like in or adjacent to the upright on one side of the block; and/or in or adjacent to the cross member; and/or in or adjacent to the upright on the other side of the block.

The snap fit is preferably tamper resistant so that the cover portion cannot be removed without the use of a tool, or without destruction of or damage to the cover portion or to the block.

Preferably, the cover is of injection or blow molded plastics. For such a component, it is feasible to use a colored plastics material of an appropriate high visibility color such as yellow or orange. By contrast, the block itself may be made from recycled plastics to save expense and will generally be of a grey or black color.

The combination of a molded brightly colored portion with a molded main body of dull colored recycled plastics is inventive in its own right and thus viewed from a second aspect the invention a base for supporting posts of fencing, comprising a block having a main body with a lower surface, an upper surface, two ends and two sides, wherein the lower surface is for resting on a support and the upper surface is provided with at least two apertures for receiving the respective ends of fencing posts to project upwardly from the upper surface; and each end of the block is provided with a gripping portion which projects away from the main body of the block; wherein the main body is of molded recycled thermoplastic material and attached to the thermoplastic material of the main body is a visible portion of molded plastics which is of a relatively bright color as compared to the color of the thermoplastic material of the main body.

The visible portion may be a portion which snaps on to the main body, for example a cover as described in connection with the first aspect of the invention. However there are other ways in which the visible portion can be attached to the main body. The include: (i) pre-molding the visible portion, inserting it into the mold for the main body, and then molding the material of the main body around the visible portion; (ii) welding the visible portion on to the main body; and (iii) bonding the visible portion on to the main body using a suitable bonding agent. In any of these cases a visible portion may be provided on one or both of the gripping portions.

In some embodiments of this second aspect of the invention, each end of the main body block is provided with a gripping portion which projects away from the main body of the block, and at least one of those ends is provided with a visible portion of moulded plastics which is of a relatively bright color as compared to the color of the thermoplastic material of the main body. Preferably, both ends are provided with such a visible portion.

Viewed from a third aspect, the invention provides a base for supporting posts of fencing, comprising a block having a main body with a lower surface, an upper surface, two ends and two sides, wherein the lower surface is for resting on a support and the upper surface is provided with at least two apertures for receiving the respective ends of fencing posts to project upwardly from the upper surface; and each end of the block is provided with a gripping portion which projects away from the main body of the block; wherein the main body of the block and the gripping portions are of molded recycled thermoplastic material, and at least one of the gripping portions is provided with a visible part which is of a relatively bright color as compared to the color of the thermoplastic material of the main body.

In this third aspect of the invention the visible part which is of a relatively bright color may be provided by (i) a portion which snaps on to the gripping portion, for example as described with reference to the first aspect of the invention; (ii) pre-molding a visible portion, inserting it into the mold for the base, and then molding the material of the base around the visible portion; (iii) welding a visible portion on to the gripping portion; (iv) bonding the visible portion on to the gripping portion using a suitable bonding agent; or coloring part or all of a gripping portion, for example by means of paint.

Preferably both of the gripping portions are provided with a visible part which is of a relatively bright color as compared to the color of the thermoplastic material of the main body.

In embodiments of any of the aspects of the invention, the upper surface of the block may be provided with any desired arrangement of apertures, whose shape, size and orientation will be chosen to match the types of fencing post or other structural elements with which the base is to be used. For example, the apertures may have a cross section which is circular, square or cruciform. There may be a combination of apertures with different types and/or sizes. There may be three apertures positioned so that three fencing panels can meet. In one preferred arrangement, there are two laterally spaced circular apertures adjacent one end of the block and two laterally spaced circular apertures adjacent the other end of the block. Preferably in such an arrangement, there are two laterally spaced circular apertures in a central region of the block. There may be a third aperture adjacent said one end of the block, longitudinally spaced from the other two apertures adjacent that end; and/or a third aperture adjacent said other end of the block, longitudinally spaced from the other two apertures adjacent that end; and/or a third aperture in the central region of the block, longitudinally spaced from the other two apertures in that region.

Where two or three apertures are provided adjacent each other, preferably they are separated by a standard amount corresponding to the dimensions of a clip used to link fencing posts together in such systems—for example being spaced apart by 90 mm. This means that where fencing panels are joined, there will be no more than a standard gap between them.

In some embodiments, the main body of a base in accordance with the various aspects of this invention is of generally oblong shape, with two parallel sides which are substantially longer than the ends of the main body. In general such a base will be used with its longer dimension at right angles to the plane of fencing panels, so as to resist the panels tilting forwards or backwards.

These aspects of the invention also extend to a fencing system comprising a plurality of fencing panels and a plurality of the bases, the fencing panels having posts which are received in apertures of the bases, and at least one base receiving posts from two different fencing panels. The fencing panels may be metallic, for example being of galvanized steel, or of plastic.

The support on which the base rests may be at ground level, such as the ground a road, a pavement, a paved area and so forth, or could be elevated such as on a flat roof where work is being carried out.

Further features of some embodiments of the invention concern the nature of the apertures used to receive posts of fencing panels. When circular apertures are provided, these will be of somewhat larger diameter than the pole which they are intended to receive; if there was not such tolerance it would be extremely difficult to insert the poles. In a standard type of arrangement, there is a bore with a constant diameter, with the possible exception of a chamfered portion adjacent the opening into the bore or an exit from the bore. The diameter of the bore is chosen to ensure that there is a reasonably secure fit and tendency of a pole to tip away from the vertical direction is reduced. However, the opening into the bore must be sufficiently wide to ensure that a pole can be inserted without difficulty.

A typical arrangement is that a fencing pole has an external diameter of 40 mm. and the main part of the bore has a diameter which is 45 mm. After the pole has been inserted in the bore, it will tilt so that a lower part of the pole in the bore engages one side of the bore and an upper part of the pole in the bore engages the opposite side of the bore. As a result the axis of the pole will not point vertically but will extend at a slight angle to vertical. The closer that the bore diameter is to the diameter of the pole, the smaller will be the angle between vertical and the axis of the pole. However, the closer that the bore diameter is to the diameter of the pole, the more difficult it is to insert the pole.

Accordingly, in some embodiments of the various aspects of the invention, the apertures in the upper surface of the block are openings into bores to receive cylindrical poles of fencing, wherein the diameter of the bore decrease from a first value adjacent an upper end thereof to a second value adjacent a lower end thereof. Thus the diameter adjacent the upper end of the bore will be chosen as large enough to facilitate insertion of a pole, and there may be an initial chamfered portion to further assist insertion. However, lower down where an end part of the pole will engage the side of the bore, the bore will be of smaller diameter and this will result in a reduced angle of tilt compared to the case if the bore was of constant diameter.

This arrangement restricts the amount by which the pole can tilt, which is an advantage in respect of movement in a plane perpendicular to the plane of the fencing panels themselves. However, there is less need to restrict movement in the plane of the fencing panels, as the presence of neighboring panels will serve to restrict that movement. Indeed, an increase in the degree of play in that plane may make it easier to install a fencing system.

Thus, in some embodiments of the invention, the apertures in the upper surface of the block are openings into bores to receive fencing poles, wherein the cross section of the bore adjacent at least one end thereof end has a minimum dimension in a direction which is perpendicular to the plane of a fencing panel in an intended configuration and is elongated in a direction which is in the plane of a fencing panel in that intended configuration. In such an arrangement, the minimum dimension of the cross section could correspond to the diameter that there would be if using a bore with a circular cross section. This minimum dimension could be constant throughout the length of the bore (ignoring a chamfered opening at one or both ends) or increase from a first value adjacent one end of the bore to a second value adjacent the other. As described above this minimum dimension could be greater adjacent the upper end of the bore than adjacent the lower end of the bore. In any event, this minimum dimension will be in a direction perpendicular to the intended plane of a fencing panel whose pole is received in the bore in use. However, in a direction which is at right angles to that, i.e. in the plane of the fencing panel, the cross section of the bore is elongated. The cross section could be in the form of an oblong, or for example in the form of an oblong with rounded ends. It will be appreciated that where there is a reference to a minimum dimension, this refers to the spacing between the two long sides of the oblong, rather than to a dimension in the region of the rounded end.

With such an arrangement, if the axis along which the cross section is elongated lies in the plane of a fencing panel, there will still be resistance to tilting in a direction at right angles to that plane. However there will be a greater degree of play for tilting in the plane of the fencing panel which will assist when connecting it to a second base or to a second panel.

The dimension of the bore cross section in the direction perpendicular to the intended plane of a fencing panel, may be constant throughout the length of the bore (ignoring any chamfered portion adjacent one of both ends). Alternatively it could increase from a first value adjacent one end of the bore to a second value adjacent the other end of the bore. In a preferred arrangement, the dimension of the bore cross section in the direction perpendicular to the intended plane of a fencing panel, is at a minimum adjacent the upper surface of the block. At the upper surface, the bore cross section could be circular. Thus the appearance could emulate that of a standard block, whilst still providing the increase degree of play in the plane of the fencing as a result of the elongated bore cross section adjacent the lower end of the bore.

In some embodiments, the block includes a plurality of bores, two of which have a cross section which adjacent at least one end is elongated in the same first direction, and at least one of which has a cross section which adjacent at least one end is elongated in a second direction perpendicular to the first direction. Thus, for example, the said two bores could receive the posts of panels which lie in a first plane, and the said one bore could receive the post of a panel which extends in a direction which is perpendicular to the first two panels.

The use of the expression "bore" does not imply that the bore must be continuous. Nor does the statement that a dimension varies from one end of the bore to the other imply that there is a continuous variation of the dimension. For example, the bore could comprise two axially aligned but separate portions, one adjacent the upper surface of the block and one spaced lower down in the block. The two portions could have different cross sections. For example one could be of circular cross section throughout (for example, constant so as to be cylindrical) and the other could also be of circular cross section throughout, but having a different diameter or range of diameters if the diameter varies. One portion could be of circular cross section throughout, whether constant or varying, and the other could have an elongated cross section as described above. Both could have an elongated cross section, but with different dimensions or ranges of dimensions. Furthermore where it is stated that a bore has a dimension adjacent an end of the bore, this excludes the effect of a chamfered portion. The use of the expression "perpendicular" does not imply a strict geometrical relationship in which one member is at exactly 90 degrees to another member These various features concerning the bores are inventive in their own right, whether or not used in the context of a bases as described in connection with the first, second and third aspects of the invention.

Thus viewed from a fourth aspect of the invention, there is provided a base for supporting posts of fencing, comprising a block having a lower surface and an upper surface, wherein the lower surface is for resting on a support and the upper surface is provided with at least two apertures for receiving the respective ends of fencing posts to project upwardly from the upper surface; wherein the apertures in the upper surface of the block are openings into bores to receive fencing poles, wherein the cross section of the bore adjacent at least one end thereof end has a minimum dimension in a direction which is perpendicular to the plane of a fencing panel in an intended configuration and is elongated in a direction which is in the plane of a fencing panel in that intended configuration.

Viewed from a further aspect of the invention, there is provided a base for supporting posts of fencing, comprising a block having a main body with a lower surface, an upper surface, two ends and two sides, wherein the lower surface is for resting on a support and the upper surface is provided with at least two apertures for receiving the respective ends of fencing posts to project upwardly from the upper surface; and each end of the block is provided with a gripping portion which projects longitudinally away from the main body of the block; wherein interlocking means is associated with one of the gripping portions and interlocks with a corresponding interlocking means of a cover portion which is fitted to the block over the gripping portion, the cover portion being provided with (i) a top, upwardly directed face; and/or (ii) at least one sideways directed face; and/or (iii) an end face.

The various aspects of the invention also extend to a fencing system comprising a plurality of fencing panels and a plurality of the bases, the fencing panels having posts which are received in the apertures of the bases, and at least one base receiving posts from two different fencing panels. The fencing panels may be metallic, for example being of galvanized steel, or of plastic.

It will be appreciated that expressions such as "enhanced visibility compared to the main body of the block", "contrasting color", "high visibility color", "brightly colored" and "relatively bright color" apply to all embodiments of aspects of the invention which include a portion, such as a cover, which is provided to enhance visibility of an end of the base for fencing, or both ends of the base for fencing.

The present device and advantages associated therewith will become more readily apparent in view of the detailed description provided below, including the accompanying drawings.

BRIEF DESCRIPTION OF THE DRAWINGS

Some embodiments of the invention will now be described by way of example and with reference to the accompanying drawings.

FIG. 15 shows part of a block with bores have a varying cross section.

FIG. 16 is a section showing a pole in position.

FIG. 17 is a diagram illustrating the position if a pole was used with a bore having a constant, wide cross section.

FIG. 18 shows part of a block with bores having a cross section which is elongated in one direction.

FIG. 19 is a sectional view in the direction of arrow A or D on FIG. 18, with a pole in position.

FIG. 20 is a sectional view in the direction of arrow B or C on FIG. 18, with a pole in position.

DETAILED DESCRIPTION

Figure 1:
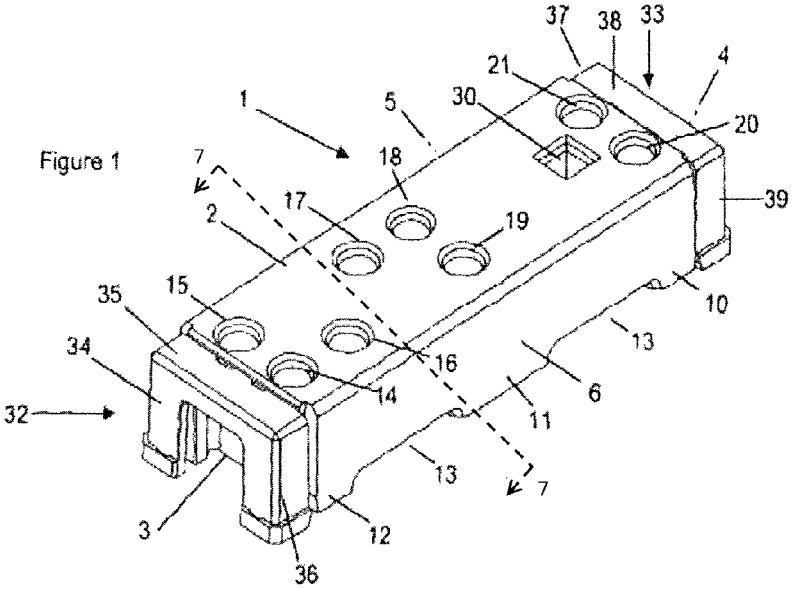
FIG. 1 is a perspective view of a block in accordance with the invention.
Figure 2:
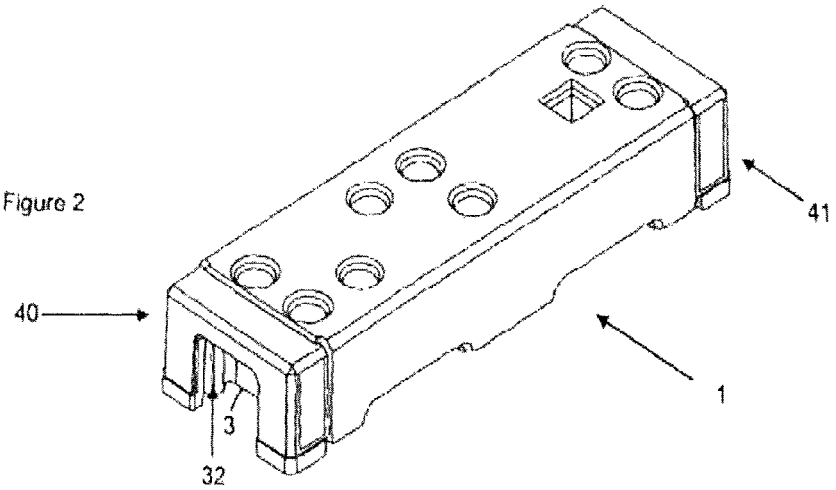
FIG. 2 is a perspective view of the block with end units snapped into place.
Figure 3:
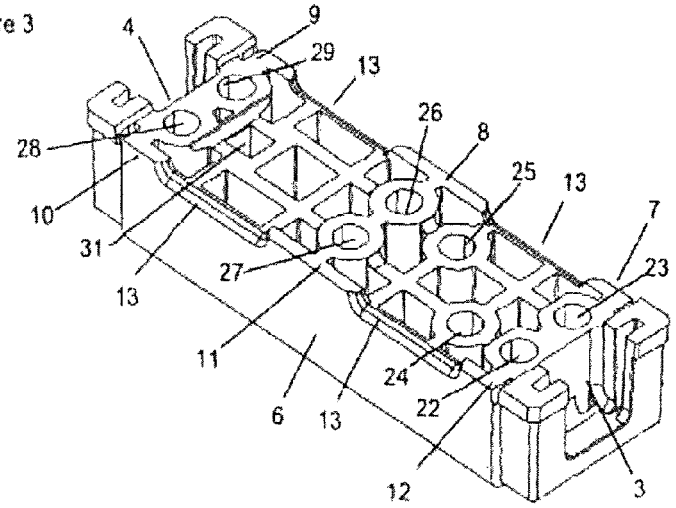
FIG. 3 is an underneath perspective view of the block of FIG. 2.
Figure 4:
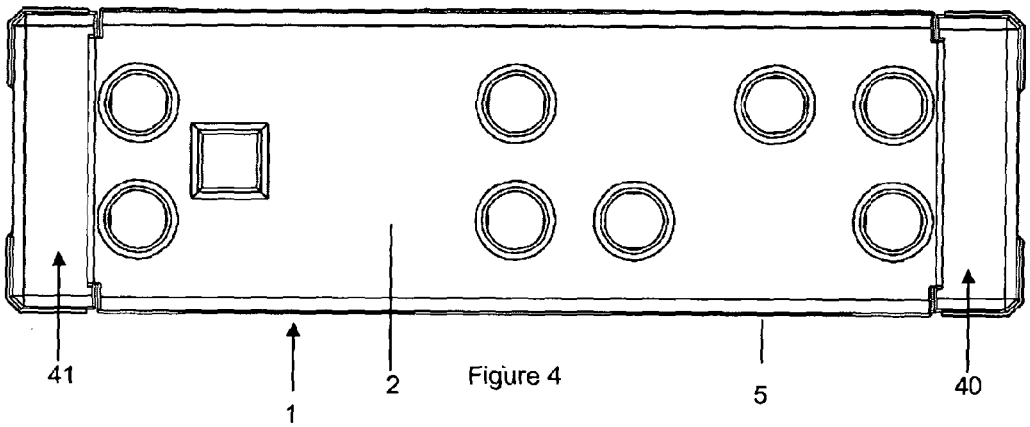
FIG. 4 is a top plan view of the block.
Figure 5:
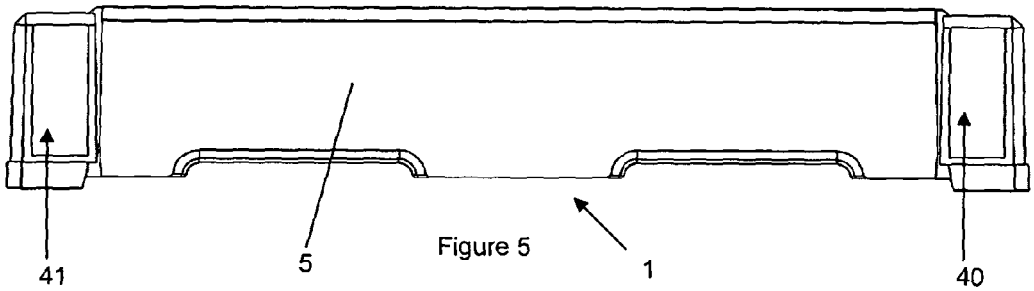
FIG. 5 is a side view of the block.
Figure 6:
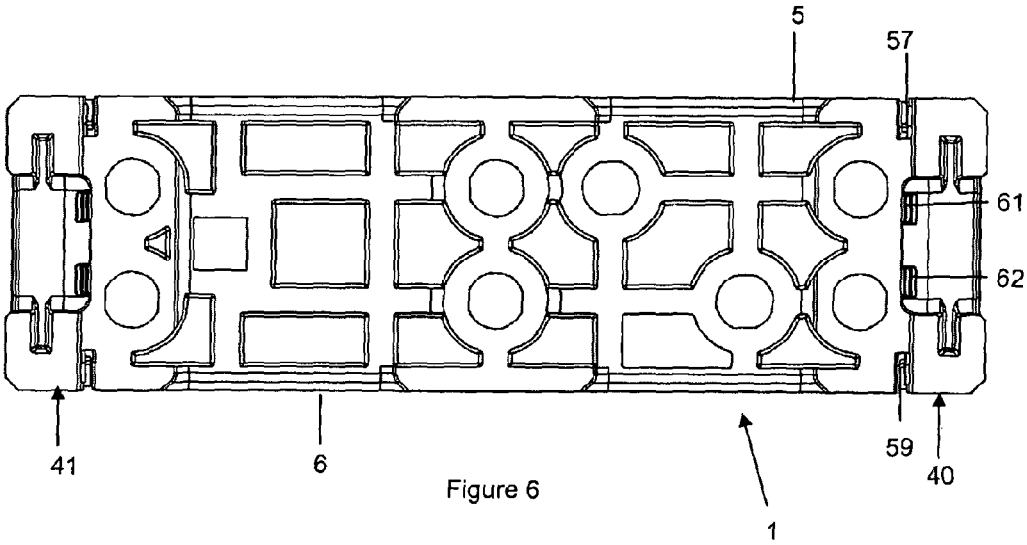
FIG. 6 is an underneath plan view of the block.

Referring now in detail to the drawings, in FIGS. 1 to 7 there is shown a base for receiving one or more poles of a fence or barrier system, in the form of a block 1. The block 1 has a generally oblong top surface 2, a front end 3, a rear end 4, a left side 5 and a right side 6. The block is elongated, being longer than it is wide. The block has a number of bottom surface portions 7 to 12, which lie in a plane, so that it can rest on a surface. The portions are separated by spaces 13 along the sides 5 and 6 of the block. The top surface is provided with a number of circular apertures 14 to 21, which open into downwardly extending bores respectively 22 to 29, of circular cross section. These bores have open bottoms. There is also a square cross section aperture 30 which opens into a downwardly extending passage 31 of square cross section. This has an open bottom. All of the apertures 14 to 21, and 30, have chamfered edges. The bores 22 to 29 are adapted to receive cylindrical posts of fencing or barrier panels, and the passage 31 is adapted to receive the bases of other elements such as upwardly extending warning panels.

The block is molded from recycled thermoplastic material, such as a tough durable rubber type compound which will typically be black or grey in color. The material is sufficiently dense to provide the block with sufficient weight to be stable when fencing or a barrier is being supported.

As shown in FIG. 1, at the front end of the block 1 is an integrally formed handle portion 32 and at the rear end of the block is a correspondingly shaped handle portion 33. The front handle portion 32 has a left side upright 34, an upper cross piece 35 and a right side upright 36. These provide a top, upwardly facing surface; a left sideways facing surface, a right sideways facing surface; and an end facing surface. The rear handle portion has a left side upright 37, an upper cross piece 38 and a right side upright 39 which also provide a top, upwardly facing surface; a left sideways facing surface, a right sideways facing surface; and an end facing surface. The block can be lifted and transported/manipulated by using the cross pieces 35 and 38 as gripping portions with the fingers extending into the space beneath each cross piece. The top surfaces of cross pieces 35 and 38 are slightly lower than the top surface 2 of the block. Similarly the left facing surfaces of left side uprights 34 and 37 are set in slightly from the left side 5 of the block, and the right facing surfaces of right side uprights 36 and 39 are set in slightly from the right side 6 of the block.

Figure 7:
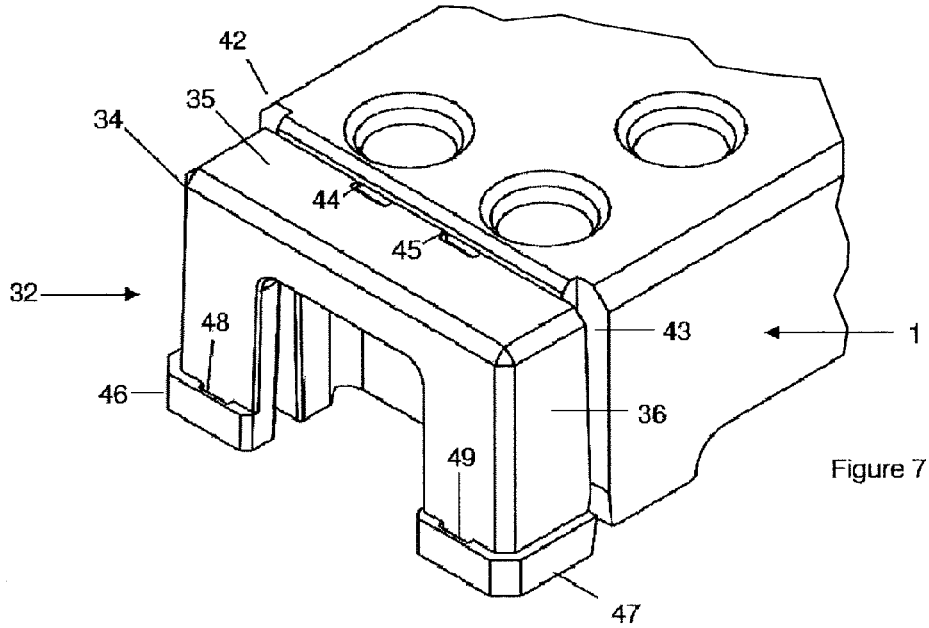
FIG. 7 is an enlarged view of one end of the block of FIG. 1.

As shown in FIGS. 2 to 7, at each end of the block the handle 32 or 33 is provided with an injection molded, brightly colored cover 40, 41, for example of yellow plastics. The means by which the cover is attached will be described with respect only to the handle 32 at the front end 3. The handle at the rear end corresponds. As shown in FIG. 7, the handle 32 is provided with a groove 42 where it joins the main part of the block, extending up the upright 34, and a groove 43 extending up the other upright 36. There are two notches 44 and 45 in the upper surface of the cross piece 35, adjacent where it joins the main body of the block. The uprights 34 and 36 have enlarged bases 46 and 47 which are provided with recesses 48 and 49 in their front upper parts.

Figure 8:
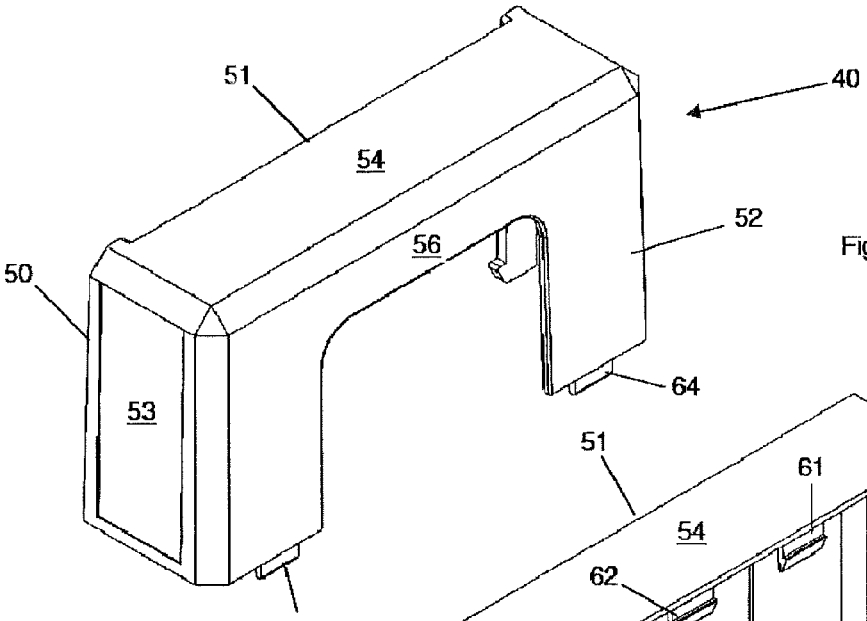
FIG. 8 is a front perspective view of one of the end units.
Figure 9:
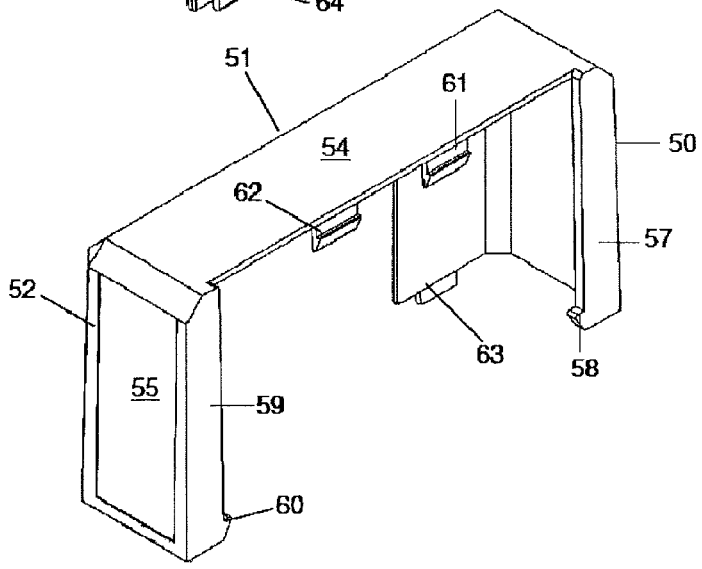
FIG. 9 is a rear perspective view of the end unit.

As shown in FIGS. 8 and 9, the cover 40 is in the form of a bridge with a left upright 50, a cross piece 51 and a right upright 52. These provide a left facing surface 53 to cover the left sideways facing surface of the handle portion 32; a top upwardly facing surface 54 to cover the top, upwardly facing surface of the handle portion 32; and a right facing surface 55 to cover the right sideways facing surface of the handle portion 32. The cover 40 also has an end facing surface 56. One portion of this end facing surface 56 covers the end facing surface of the left side upright of the handle portion 32; another portion of this end facing surface 56 covers the end facing surface of the right side upright of the handle portion 32; and a third portion covers the end facing surface of the cross piece of the handle portion 32.

The cover 40 has a left upright portion 57 for engaging in groove 42, having a latching portion 58 at its lower end. The cover 40 also has a right upright portion 59 for engaging in groove 43, having a latching portion 60 at its lower end. The cross piece is provided with two latching portions 61 and 62 for engaging in notches 44 and 45. The lower end of the front part of upright 50 is provided with a tab 63 for fitting in recess 48, and the lower end of the front part of upright 52 is provided with a tab 64 for fitting in recess 49.

The cover 40 can be snapped in place over the handle 32, terminating adjacent the enlarged bases 46 and 47. In a similar manner the cover 41 can be snapped in place over the handle 33.

For each of the covers 40 and 41, the left and right uprights are inset from the sides of the block; the cross piece is inset down from the top of the block; the lower ends of the uprights are inset up from the bottom of the block, i.e. the enlarged bases 46 and 47; and the front face 56 is inset in from the end of the block as defined by the front parts of the enlarged bases 46 and 47. Thus, each cover is inset from the extremities of the block and is thus protected from damage, for example if blocks are stacked on top of each other Thus a brightly colored cover can be provided at one, or both, ends of the block without interfering with the functions of the handles.

The cover 40 can be modified by the addition of a reflector on the left facing surface 53. A similar reflector can be provided on the right facing surface 55. A trade mark or the like could be provided on the upwardly facing surface 54, for example.

The precise arrangement of apertures in the upper surface of the block can be altered as desired.

Figure 10:
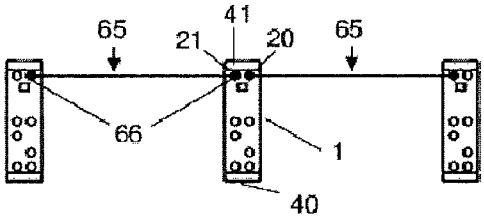
FIG. 10 shows a first arrangement of fencing panels and blocks as shown in FIGS. 1 to 8.

FIG. 10 shows in diagrammatic form how a plurality of the bases 1 can be used with fencing panels. In this case, there are three bases 1 and two fencing panels 65, each of which has two upright supporting poles 66 at the edges of the panel which are received in the respective apertures 20 and 21 of the respective base. The main part of the panel can for example be of steel wire. In this case there is a simple planar array of fencing panels and the central base serves to support the two posts of adjacent panels. These could be joined together by a clamp in the normal way. The bases project only a short distance forward of the line of fencing panels, and both ends are provided with the brightly colored end covers 40 and 41. The length of each base prevents the panels tipping forwards or backwards out of the plane of the fencing.

Figure 11:
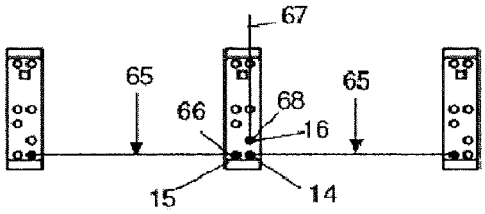
FIG. 11 shows a second arrangement of fencing panels and blocks.

FIG. 11 shows a similar arrangement to that of FIG. 10, in which there are two planar fencing panels 65 with poles 66 received in apertures 14 and 15, and an additional fencing panel 67 extending perpendicularly to the panels 65, with a post 68 in aperture 16 of the central base. The other end of panel 67 will also be supported in a base 1.

Figure 12:
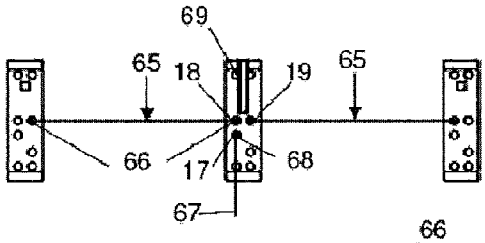
FIG. 12 shows a third arrangement of fencing panels and blocks.

FIG. 12 shows an alternative arrangement using the central apertures 18 and 19 in each of the bases 1. There is a planar array of fencing panels 65 having posts 66, and there is a panel 67 with post 68 received in aperture 17, extending perpendicularly to the planar array. The other end of panel 67 will also be supported in a base 1. In this arrangement, a vertical warning panel 69 is located in the square aperture 30.

Figure 13:
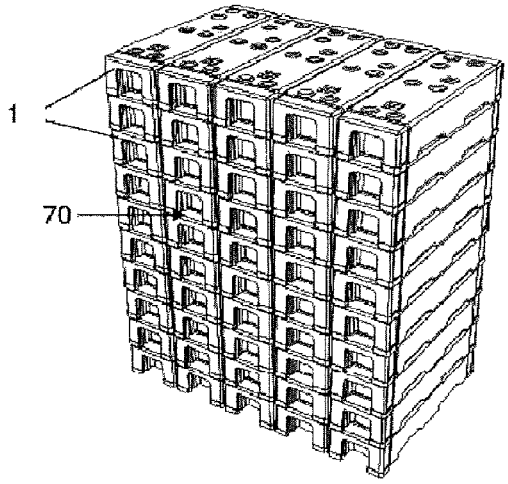
FIG. 13 shows how blocks in accordance with the invention may be stacked.

FIG. 13 shows how a number of the bases 1 can be out together to form a stack 70 for storage or transport.

Figure 14:
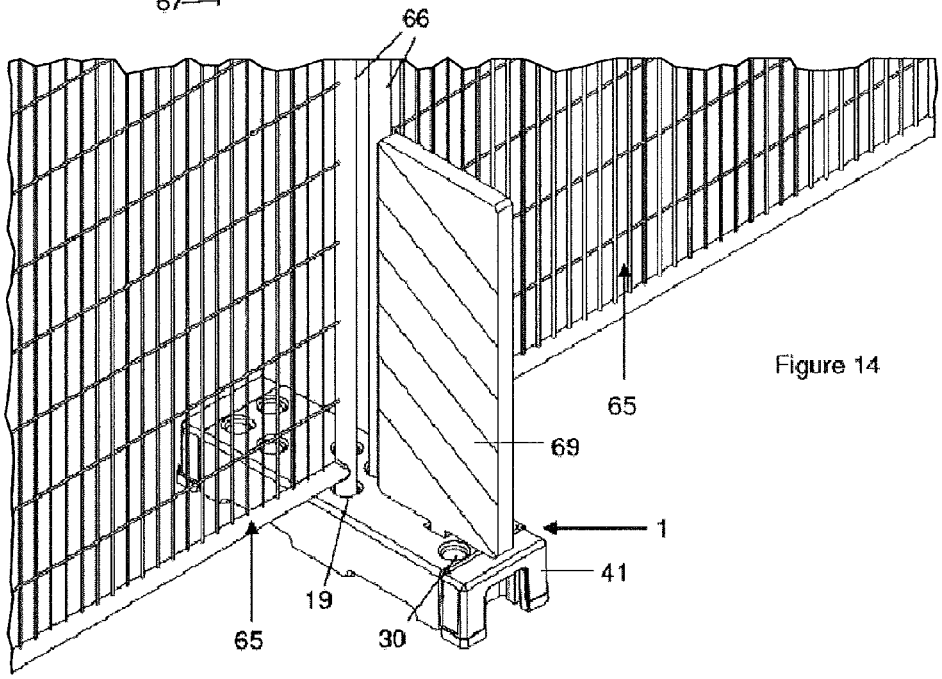
FIG. 14 shows an auxiliary element used with a block.

FIG. 14 is enlarged perspective view showing how the warning panel 69 is received in the square aperture 30 and used together with panels 65 with posts 66 received on apertures 18 and 19

FIGS. 15 and 16 show in diagrammatic form, with angles exaggerated, how bores 71 in a base 72 receive poles 73 in an embodiment of the invention. In this case the bore has an upper opening 74 and tapers inwardly to a lower opening 75. When the pole 73 is in position it will rest at an angle of Ǿ to the vertical, indicated by axis y. The larger diameter opening 74 facilitates insertion of the pole 73, but the smaller diameter lower down the bore restricts the angle Ǿ. FIG. 17 illustrates what the position would be if the upper opening 74 was the same diameter as opening 75, and the bore 71 remained at the same diameter throughout. The pole 73 would rest at a significantly larger angle ω to the vertical. In practice there may be a number of possible dimensions used. For example, with a pole diameter of about 38 mm, possible diameters for the upper and lower diameters respectively could be: (i) 43.5 mm and 43 mm; (ii) 44 mm and 42.5 mm; and (iii) 44 mm and 42 mm. The combinations (i) and (ii) provide substantially the same angle of inclination, thus illustrating how the upper opening can be made larger to facilitate hole insertion, whilst reducing the diameter of the lower opening so as not to increase the angle of tilt. Combination (iii) provides the smallest angle of tilt.

FIGS. 18 to 20 show how a bore can have a profile that permits an increased degree of freedom of pole movement in one direction. In this embodiment a base 76 is provided with three bores, 77, 78 and 79. Bore 78 is spaced laterally of bore 77, and bore 79 is spaced longitudinally of bore 77. Each bore has an upper opening 80, which is circular, to receive a pole 73 of a fencing panel. However the bores change profile from the top to the bottom. Each bore 77 and 78 maintains a constant dimension in the longitudinal direction of the base, but the dimension in the lateral direction increases so that at the lower end of the bore the cross section is essentially oblong as shown at 81. On the other hand, bore 79 maintains a constant dimension in the lateral direction of the base, but the dimension in the longitudinal direction increases so that at the lower end of the bore the cross section is essentially oblong as shown at 82. This means that whilst the freedom of movement of a fencing pole received in a bore is unchanged in one direction, so as not to increase the angle of tilt in that direction, there is additional freedom of movement in a perpendicular direction. This can be seen in FIGS. 19 and 20, which are sectional diagrams with angles exaggerated. FIG. 19 shows a view of bore 77 in the direction "A" and of bore 79 in the direction of arrow D. The angle of tilt is limited to θ. FIG. 20 shows a view of bore 77 in the direction "B" and of bore 79 in the direction of arrow "C". The angle of possible tilt Φ is significantly more. In use, a planar fencing array will extend laterally across the base 76 with poles supported in bores 77 and 78. The poles will not tilt forwards or backwards excessively. Although the bores 77 and 78 provide a greater degree of freedom of movement in the plane of the fencing panels, the panels support each other and this freedom of movement is only relevant when installing the fencing. Bore 79 will receive a pole of a fencing panel which extends in the longitudinal direction, and thus the additional freedom of movement is in the plane of that panel.

It will be appreciated that the features of FIGS. 15 and 16 could be combined with those of FIGS. 18 to 20. It will also be appreciated that the upper ends of the bores, and the lower ends if desired, could be chamfered or provided with rounded edges, without affecting the behavior as set out above.

Figure 21:
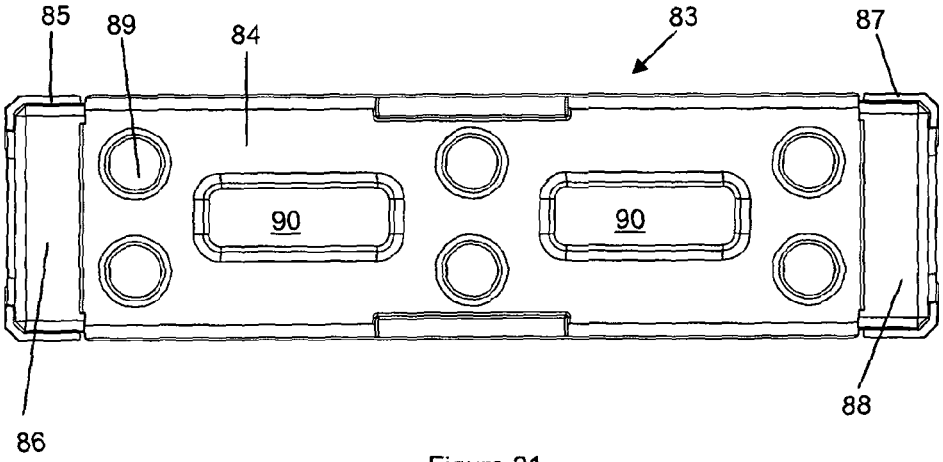
FIG. 21 is a top plan view of a block showing an alternative arrangement of apertures in its upper surface.

The block 83 of FIG. 21 is identical to the block of FIGS. 1 to 14, save as regards the arrangement of bores. Thus the block has a main body 84, one end portion 85 with a high visibility cap 86, and another end portion 87 with a high visibility cap 88. In this embodiment, there are six bores 89 for receiving fence pole. In addition, there are two elongate, generally rectangular bores 90. When the block is on its side, these bores 90 can receive the tines of a fork lift truck. Thus a number of these blocks can be placed in series in that manner, and will the effectively form a pallet on which other blocks can be placed.

It will thus be seen that embodiments of the invention provide base for supporting posts of fencing, comprises a block of recycled plastics provided with apertures for receiving the ends of fencing posts. Each end of the block is provided with a gripping portion which projects longitudinally away from the main body of the block. First interlocking means is associated with one of the gripping portions and interlocks with corresponding second interlocking means of a cover which is fitted to the block over the gripping portion. The cover is of enhanced visibility compared to the main body of the block which is of a dull color, to provide a warning to pedestrians.

In embodiments of the invention, the cover is fitted over the gripping portion but does not extend over a substantial portion of the main body of the block. The enhanced visibility is provided adjacent the end of the block or in some embodiments adjacent both ends of the block, but is not provided over much, or any, of the main body of the block.

Although this invention has been shown and described with respect to the detailed embodiments thereof, it will be understood by those skilled in the art that various changes in form and detail may be made without departing from the spirit and scope of the invention.

What is claimed is:

1. A fencing post base, comprising:

a main body (MB) with a MB lower surface, a MB upper surface, a first end, a second end, a first MB side surface, and a second MB side surface, wherein the MB upper surface is provided with at least two apertures each for receiving a portion of a respective fencing post, each of which respective fencing posts projects upwardly from the MB upper surface when the portion of the respective fence post is received within the respective aperture, a first gripping portion connected with and extending out from the first end, a second gripping portion connected with and extending out from the second end;

wherein the first gripping portion (FGP) includes a FGP upper surface, a first FGP side surface, a second FGP side surface, and a FGP end surface, wherein the FGP upper surface and the FGP end surface extend between the first and second FGP side surfaces, and the FGP end surface includes an opening that defines a FGP handle;

wherein the second gripping portion (SGP) includes a SGP upper surface, a first SGP side surface, a second SGP side surface, and a SGP end surface, wherein the SGP upper surface and the SGP end surface extend between the first and second SGP side surfaces, and the SGP end surface includes an opening that defines a SGP handle;

wherein the main body comprises a recycled plastics material;

a first cover portion attached to the first gripping portion, and the first cover portion covers at least a part of the FGP upper surface, at least a part of the first FGP side surface, at least a part of the second FGP side surface, and at least a part of the FGP end surface; and a second cover portion attached to the second gripping portion, and the second cover portion covers at least a part of the SGP upper surface, at least a part of the first SGP side surface, at least a part of the second SGP side surface, and at least a part of the SGP end surface; and wherein the first cover portion and the second cover portion each comprise a virgin plastics material of enhanced visibility compared to the main body.

2. The base of claim 1, wherein the first gripping portion includes a first upright, a second upright, and an upper cross member extending between the first and second uprights.

3. The base of claim 2, wherein first upright and the second upright of the first gripping portion each have an enlarged lower end and the first cover portion extends to and terminates adjacent the lower end of each respective upright.

4. The base of claim 1, wherein the second gripping portion includes a first upright, a second upright, and an upper cross member extending between the first and second uprights.

5. The base of claim 4, wherein first upright and the second upright of the second gripping portion each have an enlarged lower end and the second cover portion extends to and terminates adjacent the lower end of each respective upright.

6. The base of claim 1, wherein the first cover portion covers substantially all of the first gripping portion.

7. The base of claim 1, wherein the second cover portion covers substantially all of the second gripping portion.

8. The base of claim 1, wherein the first cover portion is mechanically attached to the first gripping portion, and the second cover portion is mechanically attached to the second gripping portion.

9. The base of claim 1, wherein the first cover portion covers the handle of the first gripping portion.

10. The base of claim 1, wherein the first cover portion covers the handle of the first gripping portion, and the second cover portion covers the handle of the second gripping portion.

11. The base of claim 1, wherein the first cover portion is inset from the first MB side surface, the second MB side surface, and the MB upper surface, and the second cover portion is inset from the first MB side surface, the second MB side surface, and the MB upper surface.

12. A fencing system, comprising:

at least one fencing panel that includes at least one support post; and at least one fencing post base that includes:

a main body (MB) with a MB lower surface, a MB upper surface, a first end, a second end, a first MB side surface, and a second MB side surface, wherein the MB upper surface is provided with at least two apertures each for receiving a portion of a respective fencing panel support post, each of which respective fencing panel support posts projects upwardly from the MB upper surface when the portion of the respective fencing panel support post is received within the respective aperture, a first gripping portion connected with and extending out from the first end, a second gripping portion connected with and extending out from the second end;

wherein the first gripping portion (FGP) includes a FGP upper surface, a first FGP side surface, a second FGP side surface, and a FGP end surface, wherein the FGP upper surface and the FGP end surface extend between the first and second FGP side surfaces, and the FGP end surface includes an opening that defines a FGP handle;

wherein the second gripping portion (SGP) includes a SGP upper surface, a first SGP side surface, a second SGP side surface, and a SGP end surface, wherein the SGP upper surface and the SGP end surface extend between the first and second SGP side surfaces, and the SGP end surface includes an opening that defines a SGP handle;

wherein the main body comprises a recycled plastics material;

a first cover portion attached to the first gripping portion, and the first cover portion covers at least a part of the FGP upper surface, at least a part of the first FGP side surface, at least a part of the second FGP side surface, and at least a part of the FGP end surface; and a second cover portion attached to the second gripping portion, and the second cover portion covers at least a part of the SGP upper surface, at least a part of the first SGP side surface, at least a part of the second SGP side surface, and at least a part of the SGP end surface; and wherein the first cover portion and the second cover portion each comprise a virgin plastics material of enhanced visibility compared to the main body.

13. The fencing system of claim 12, wherein the at least one fencing panel includes a plurality of the fencing panels, and the at least one fencing post base includes a plurality of the fencing post bases.

* * * * *